United States Patent [19]

Kessick et al.

[11] 4,343,323

[45] Aug. 10, 1982

[54] PIPELINE TRANSPORTATION OF HEAVY CRUDE OIL

[75] Inventors: Michael A. Kessick, Edmonton; C. Earl St. Denis, Fort Saskatchewan, both of Canada

[73] Assignee: Research Council of Alberta, Edmonton, Canada

[21] Appl. No.: 157,940

[22] Filed: Jun. 9, 1980

[30] Foreign Application Priority Data

Jun. 8, 1979 [GB] United Kingdom ..... 7920003

[51] Int. Cl.[3] ..... F17D 1/17

[52] U.S. Cl. ..... 137/13; 210/708; 208/370; 252/358

[58] Field of Search ..... 210/708; 137/13; 252/327, 329, 344, 358; 208/370

[56] References Cited

U.S. PATENT DOCUMENTS

| | | | |
|---|---|---|---|
| 2,568,742 | 9/1951 | Kirkpatrick | 252/329 |
| 2,568,745 | 9/1951 | Kirkpatrick | 252/329 |
| 2,702,794 | 2/1955 | Kellogg | 253/329 |
| 3,487,844 | 1/1970 | Simon | 137/13 |
| 3,519,006 | 7/1970 | Simon et al. | 137/13 |
| 3,670,752 | 6/1972 | Marsden | 137/13 |
| 3,799,872 | 3/1974 | Hargis | 252/329 |
| 4,016,076 | 4/1977 | Lefeuvre | 210/708 |
| 4,126,182 | 11/1978 | Allen | 137/13 |
| 4,182,689 | 1/1980 | Presley | 210/708 |
| 4,238,330 | 12/1980 | Fong | 210/708 |

FOREIGN PATENT DOCUMENTS

| | | | |
|---|---|---|---|
| 2138035 | 2/1973 | Fed. Rep. of Germany | 210/708 |
| 2313217 | 9/1974 | Fed. Rep. of Germany | 210/708 |
| 1280373 | 7/1972 | United Kingdom | 210/708 |

*Primary Examiner*—Ernest G. Therkorn
*Attorney, Agent, or Firm*—Sim & McBurney

[57] ABSTRACT

Heavy crude oils are transported by pipeline from deposit location to a remote upgrading location by emulsifying the crude oil using deaerated sodium hydroxide solution, conveying the oil-in-water emulsion through the pipeline, and recovery of the oil from the oil-in-water emulsion by inverting the emulsion and dewatering the resulting water-in-oil emulsion. The emulsion inversion may be effected using slaked lime, resulting in recovery of a substantial proportion of the sodium hydroxide used in the initial emulsification. The sodium hydroxide solution may be recycled by a separate pipeline for reuse or treated for discharge.

11 Claims, 3 Drawing Figures

PIPELINE TRANSPORTATION OF HEAVY CRUDE OIL

The present invention relates to the pipeline transportation of heavy crude oil.

BACKGROUND TO THE INVENTION

There exist in many parts of the world deposits of heavy crude oils which, for this reason, are difficult and expensive to exploit commercially, especially if required to be transported by pipeline from a remote well location to a terminal or a refinery. One conventional procedure for pipeline transportation involves dilution of the heavy crude oil with light oil fractions to form a tractable solution, but this technique involves logistical problems of supply of the light oil fraction, especially when long transportation distances are involved.

SUMMARY OF INVENTION

In accordance with the present invention, there is provided a procedure for the transportation of heavy crude oil which comprises emulsifying the crude oil as an oil-in-water emulsion, transporting the resulting relatively stable emulsion by pipeline to the desired location, and recovering the crude oil from the emulsion at that location.

In the present invention, the term "heavy crude oil" refers to those crude oils which are characterized by little or no flow characteristics at ambient temperatures and have an API (American Petroleum Institute) gravity value of less than 25°, usually less than 20°. Such heavy crude oils include bituminous oils recovered from oil sands and shales.

DETAILED DESCRIPTION OF INVENTION

The emulsification of the heavy crude oil is achieved using sodium hydroxide solution which has been deaerated and has a pH of at least 11. The emulsification may be effected at any desired temperature from about 0° to about 100° C. Elevated temperatures are preferred since emulsion formation is more rapid at the higher temperature and hence the preferred temperature range is about 60° to about 80° C.

The emulsion may be formed in any convenient concentration, preferably at higher concentrations, such as, about 40 to 60 wt.% bitumen, so that a higher throughput of oil in the pipeline can be achieved per unit volume of emulsion transported. When oil sands are contacted with aqueous sodium hydroxide solution to form the oil-in-water emulsion from the bitumen therein, a relatively low concentration of bitumen in the emulsion results, typically about 10 to 15 wt.%. In order to achieve the desirable higher oil concentrations, the oil-in-water emulsion may be recycled to contact further oil sand until the higher concentration is achieved.

Any other strong base may be substituted for sodium hydroxide in the emulsification step, such as lithium hydroxide, potassium hydroxide, quaternary ammonium hydroxides and ethylene diamine, but the relatively higher cost of these materials militates against their use.

Deaeration of the aqueous phase used in the process of the invention is essential for the consistent production of an oil-in-water emulsion from certain crude oils, and hence the use of deaerated sodium hydroxide solution in emulsion formation is preferred. The presence of dissolved oxygen in the aqueous phase appears to interfere with the chemical reactions involved in emulsification. Deaeration may be effected in any convenient manner, such as, by steam stripping.

It is also preferred for the aqueous phase to be substantially free from divalent cations, such as, calcium and magnesium, which also tend to interfere with the emulsification reaction, the aqueous phase may be subjected to softening prior to use to remove such ionic species, if present.

Emulsification of the heavy crude oil, either insitu or at the well head, causes the formation of an emulsion of considerably lower viscosity than the crude oil itself, even at high oil concentrations, enabling the emulsion to be very readily transported by pipeline to a remote location. It is considered essential for pipeline transportation of crude oil for the liquid to have a viscosity of less than about 200 centistokes when measured at 50° F. (15° C.). Viscosity values below this maximum are attained in the emulsions formed from the heavy crude oils.

In addition, the rheological properties of the emulsion are less dependent on temperature than the crude oil and solutions thereof in light fractions, so that the ability to effect pipeline transportation is generally unaffected by changes in ambient temperatures of the pipeline.

The oil-in-water emulsions may be passed through the pipeline at any convenient throughput rate. For example, the conventional pipeline pumping rate for crude oils of about 5 to 6 ft./sec. (about 2m/sec.) may be used.

It has previously been suggested that sodium chloride may be added to heavy crude oils emulsified with nonionic surfactants to depress the freezing point of the emulsion to enable the same to be transported at below freezing temperatures. It is believed that such procedure may be utilized with the emulsions used in this invention.

When the crude oil is required to be recovered from the emulsion, the emulsion is broken by any convenient technique. One preferred technique which recovers the alkali initially used in the emulsification involves treating the emulsion with slaked lime, optionally following an initial aeration step when beneficial, to form a water-in-oil emulsion which can be separated from the aqueous phase and dewatered by any convenient technique.

One emulsion breaking technique which has been found useful in the application of the process of the invention to heavy crude oils characterized by only minor contamination by numerals, such as clays, involves addition of a water-immiscible solvent for the oil and sufficient slaked lime to effect emulsion inversion, to the water-in-oil emulsion. To this mixture also is added a phase-separating amount of a water-soluble high molecular weight partially-hydrolyzed polyacrylamide.

The addition of the latter polymeric material causes a rapid separation into a solvent-oil phase, an aqueous phase containing recovered sodium hydroxide and a compact clay layer. The phases are readily separated one from another. The solvent-oil solution is subjected to solvent stripping to recover the solvent for reuse in the emulsion breaking step while the clay phase may be subjected to further dewatering if desired.

The addition of the slaked lime in the emulsion inversion has an ion-exchange effect on the bitumen, causing release of some of the sodium ions initially used in the emulsification of the bitumen, so that, following dewatering of the water-in-oil emulsion, an aqueous phase is obtained which contains sodium hydroxide. Similarly, if lime is used in clay dewatering additional quantities of sodium hydroxide are recovered and the calcium form of the clay results.

The aqueous phase recovered from the emulsion inversion and dewatering steps containing sodium hydroxide arising from the above-noted reactions, may be recycled to the well head by a separate pipeline, with suitable deaeration, softening and make-up of water and alkali, as required.

Alternatively, the aqueous phase may be discharged in an appropriate manner, such as, into a conventional oil field nearby, where it may serve as a caustic flood, or into a deep formation, or into a surface water system where it would be expected to be rapidly neutralized by carbon dioxide, soil acids and clays.

Further, the sodium hydroxide may be treated with a cation exchange resin to remove the sodium ions, so as to discharge alkali-free water as the effluent, for example, to a fresh water body. The cation exchange resin may be regenerated in any convenient manner when exhausted.

In addition, the sodium hydroxide solution may be simply neutralized, such as by bubbling carbon dioxide therethrough, for discharge.

Where the aqueous phase resulting from the emulsion breaking is to be discharged rather than recycled, other multivalent metal compounds, such as, calcium chloride, may be used, alone or in combination with slaked lime, in the emulsion breaking step to provide a more environmentally-acceptable effluent.

The ability to provide heavy crude oils in an oil-in-water emulsion form which can be readily transported through a pipeline from a source of the heavy crude oil to a remote location for upgrading at that location is significant from both social and economic viewpoints.

Heavy crude oil deposits generally are located in remote difficultly-accessible rural areas, such as, the Lloydminster, Cold Lake and Athabasca regions of Alberta, Canada and the Orinoco basin in Venezuela. The necessity for establishing upgrading facilities at the location of the deposits leads to considerable expense from effecting constructions in a remote location, relocation of operating personnel and the provision of housing, services, etc. to the region.

The present invention enables such difficulties to be overcome in that the upgrading facility does not need to be located at the site of the deposit but rather may be located in an established urban area remote from the deposit, since the present invention permits the normally difficulty-flowable heavy crude oil to be readily transported, in similar manner to the pipeline transportation of light crude oils.

DESCRIPTION OF PREFERRED EMBODIMENTS

Figure 1:
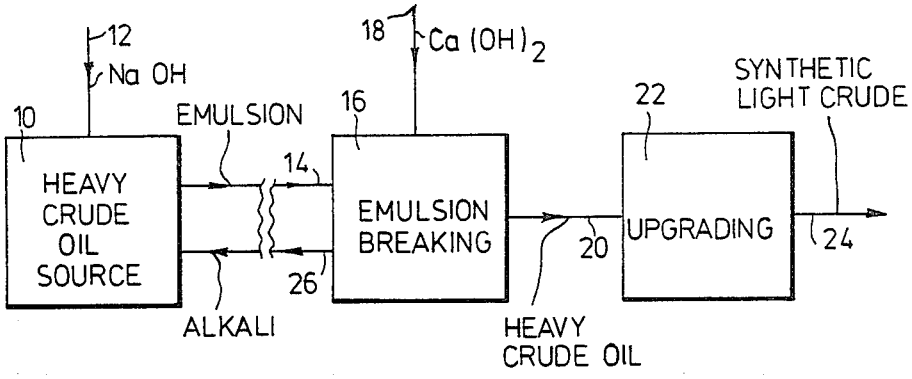
FIG. 1 is a schematic representation of one embodiment of the invention wherein recycle of recovered alkali occurs.

In the drawings, common reference numerals are used to designate common operations and in the succeeding description of the Figures of the drawings such common operations will only be described once.

Referring first to FIG. 1, an oil-in-water emulsion is formed from a crude oil source 10, which may be an insitu formation or mined crude oil, by reaction with aqueous sodium hydroxide solution fed by line 12.

The resulting emulsion then is forwarded through a pipeline 14 to any desired location 16 whereat the emulsion is broken by the addition of slaked lime by line 18 to form a water-in-oil emulsion and the dewatering of the water-in-oil emulsion. The recovered crude oil then is forwarded by line 20 to conventional upgrading 22 to form a synthetic light crude oil in line 24.

The aqueous phase resulting from the emulsion breaking containing recovered sodium hydroxide then is recycled by a parallel pipeline 26 to the crude oil source 10 for use in emulsification.

Figure 2:
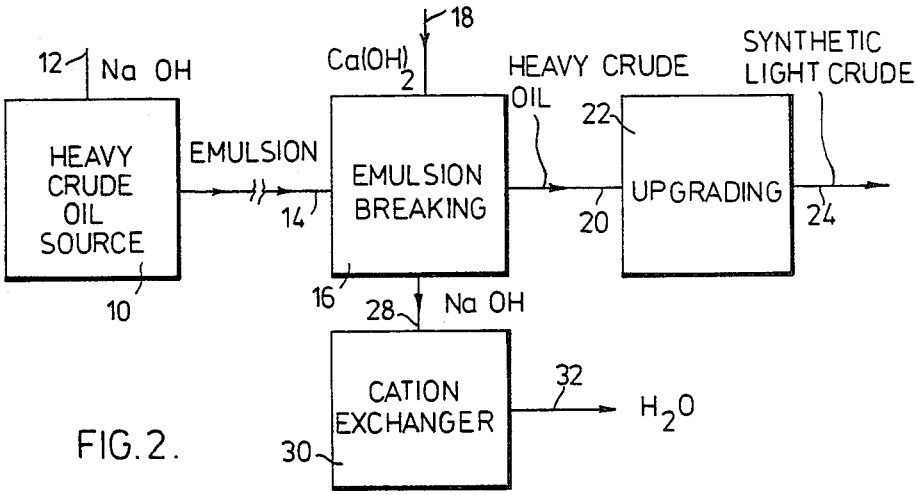
FIG. 2 is a schematic representation of a second embodiment of the invention wherein cation exchange of alkali is effected.

Referring now to FIG. 2, there is illustrated therein an embodiment of the invention wherein the recycle of alkali in accordance with the procedure of FIG. 1 is not practised but rather discharge to a fresh water body is desired.

Following emulsion breaking at the pipeline terminal 16, the sodium hydroxide solution is forwarded by line 28 to a cation exchanger 30 for removal of sodium ions and neutralization of the aqueous phase. The resulting water stream in line 32 may be discharged to a fresh water source.

Figure 3:
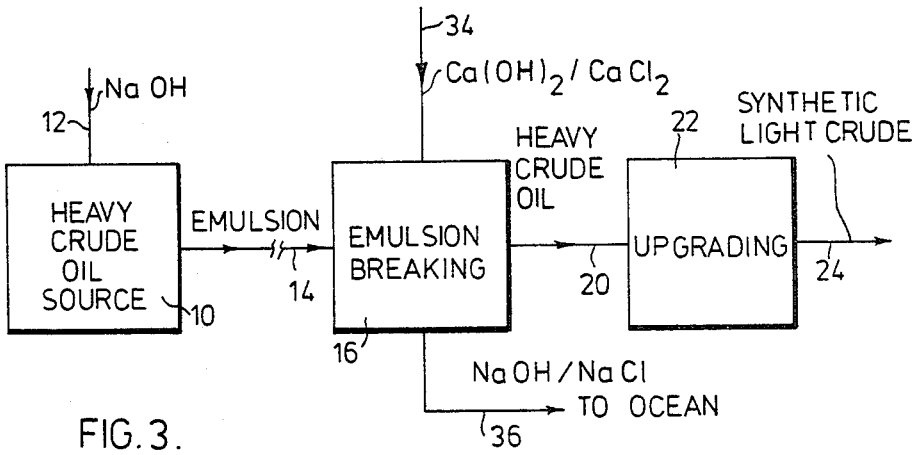
FIG. 3 is a schematic representation of a third embodiment of the invention wherein discharge of recovered aqueous phase is effected.

FIG. 3 illustrates a procedure wherein emulsion breaking is effected using slaked lime or calcium chloride fed by line 34 to result in an aqueous phase stream in line 36 containing sodium hydroxide or sodium chloride, respectively. Such a stream is acceptable to discharge to a salt water system, such as the ocean.

EXAMPLES

Example 1

100 g samples of crude oil from the primary production from the Sparky formation near Lloydminster, Alberta, Canada were emulsified at 30° C. and 70° C. using 100 ml of dilute caustic soda solution containing 0.1 g of NaOH in deaerated distilled water.

The rheological properties of the resulting emulsion at 4° C., 30° C. and 70° C. were compared with those of the crude oil itself at the same temperatures. The data for 4° C. emulsions was determined on emulsions which had been formed at 70° C. and then cooled to 4° C.

The results obtained appear in the following Table

TABLE I

| Emulsion Temperature | | | | | | Crude Oil Temperature | | | | | |
|---|---|---|---|---|---|---|---|---|---|---|---|
| 4° C. | | 30° C. | | 70° C. | | 4° C. | | 30° C. | | 70° C. | |
| Viscosity cps. | Shear Rate $sec^{-1}$ | Viscosity cps.* | Shear Rate $sec^{-1}$ | Viscosity cps. | Shear Rate $sec^{-1}$ | Viscosity cps. | Shear Rate $sec^{-1}$ | Viscosity cps. | Shear Rate $sec^{-1}$ | Viscosity cps. | Shear Rate $sec^{-1}$ |
| 100 | 0.46 | 200 | 0.46 | 200 | 0.46 | 16000 | 0.125 | 2000 | 0.17 | 300 | 0.46 |
| 100 | 0.93 | 100 | 0.93 | 50 | 0.93 | 16000 | 0.25 | 1500 | 0.34 | 200 | 0.93 |

TABLE I-continued

| Emulsion Temperature | | | | | | Crude Oil Temperature | | | | | |
|---|---|---|---|---|---|---|---|---|---|---|---|
| 4° C. | | 30° C. | | 70° C. | | 4° C. | | 30° C. | | 70° C. | |
| Viscosity cps. | Shear Rate $sec^{-1}$ | Viscosity cps.* | Shear Rate $sec^{-1}$ | Viscosity cps. | Shear Rate $sec^{-1}$ | Viscosity cps. | Shear Rate $sec^{-1}$ | Viscosity cps. | Shear Rate $sec^{-1}$ | Viscosity cps. | Shear Rate $sec^{-1}$ |
| 40 | 2.32 | 40 | 2.32 | 40 | 2.32 | 16800 | 0.625 | 1300 | 0.85 | 140 | 2.32 |
| 40 | 4.65 | 20 | 4.65 | 20 | 4.65 | 16400 | 1.25 | 1350 | 1.70 | 110 | 4.65 |
| 30 | 9.30 | 15 | 9.30 | 10 | 9.30 | 16300 | 2.50 | 1275 | 3.40 | 95 | 9.30 |
| 32.5 | 18.60 | 15 | 18.60 | 7.5 | 18.60 | 16300 | 5.00 | 1262 | 6.80 | 95 | 18.60 |
| 27.0 | 46.50 | 14 | 46.50 | 7.0 | 46.50 | 16300 | 12.50 | 1240 | 17.00 | 93 | 46.50 |
| 28.5 | 93.00 | 13 | 93.00 | 5.5 | 93.00 | — | 25.00 | 1227 | 34.00 | 91 | 93.00 |

*Centipoise = centistokes × density — the densities for the emulsions was approximately 1.

These results show that the viscosity of the emulsion is considerable less than that of the crude oil, and is of a value which permits ready pumping and transportation of the emulsion, even at 4° C. It is only when the crude oil is at 70° C. that the viscosity is at a value which may permit pipeline transportation. Both the emulsion and the crude oil exhibit pseudo-plasticity at low shear rates but exhibit Newtonian fluid characteristics at higher shear rates.

Attempts to make stable emulsions with distilled water which had not been deaerated from the same crude oil under the same conditions of temperature and alkalinity were unsuccessful.

A sample of the emulsion prepared as described above at 30° C. was treated at 70° C. with slaked lime in the amount of 0.025 g $Ca(OH)_2$ per 50 ml. Following centrifugation at 1600 xg, the system separated into two layers, the lower a clear water layer and the upper a crude oil layer containing 6.7 wt% water. At 30° C., 3.0 wt% water resulted. These results show that the crude oil can be recovered in close to 100% yield from the emulsion after pipeline transportation and may be suitable for immediate transfer to the conventional upgrading process for this type of material.

Another sample of the emulsion formed at 30° C. was mixed at 70° C. with "VARSOL" (Trademark) 3139 in a volume ratio of 2 to 1 as well as lime in the same amount as previously. On centrifugation, a lower clear water layer separated and an upper oil layer was obtained which contained 0.29 wt% water. A parallel experiment effected on a sample of the emulsion at 30° C. resulted in a water content of the oil layer of 0.5 wt%.

EXAMPLE II

The rheological properties of approximately 50 wt% oil-in-water emulsions, formed by emulsifying samples of cold bailed Lloydminster crude oil in deaerated 0.1% sodium hydroxide following the procedure of Example I, were measured at 4° C., 30° C. and 70° C. and compared with those of the crude itself.

The results are reproduced in the following Table II:

TABLE II

| Emulsion | | | | Crude oil | | | | |
|---|---|---|---|---|---|---|---|---|
| Shear Rate | Viscosity cps Temperature | | | Shear Rate | Viscosity cps. | Shear Rate | Viscosity cps Temperature | |
| $sec^{-1}$ | 4° C. | 30° C. | 70° C. | $sec^{-1}$ | 4° C. | $sec^{-1}$ | 30° C. | 70° C. |
| 0.46 | 300 | 200 | 200 | 0.125 | 122,000 | 0.41 | 4000 | 800 |
| 0.93 | 150 | 100 | 100 | 0.25 | 117,000 | 0.93 | 3900 | 400 |
| 2.32 | 140 | 40 | 40 | 0.625 | 114,800 | 2.32 | 3720 | 380 |
| 4.65 | 120 | 30 | 30 | 1.25 | 113,200 | 4.65 | 3620 | 260 |
| 9.30 | 105 | 15 | 15 | 2.50 | — | 9.3 | — | 230 |
| 18.6 | 95 | 15 | 10 | 5.0 | — | 18.6 | — | 217 |
| 46.5 | 93 | 13 | 9.0 | 12.5 | — | 46.5 | — | 219 |
| 93.0 | 92 | 13.5 | 14.0 | 25.0 | — | 93 | — | 219 |

The results of the above Table II show that the emulsion has a considerably lower viscosity than the crude oil and is of a value at least at 30° C. and 70° C. which permits pumping and transportation of the emulsion.

Stable emulsions using non-deaerated water could not be formed under the same conditions of temperature and alkalinity.

50 ml of the emulsion made at 70° C. was mixed with 50 ml of Varsol and shaken well at 70° C. After addition of 0.02 g of slaked lime, the mixture was subjected to centrifugation to result in 67 ml of an upper solvent-oil solution layer containing 0.07 wt.% water, 10 ml of a clay layer and 18 ml of a clear water layer of pH 11.8.

Another 50 ml sample of the emulsion made at 70° C. was mixed with 50 ml of Varsol and, in this case, 30 mg/l of Betz 1120 was added to the well shaken mixture subsequent to 0.02 g of slaked lime. After standing for 20 hours, there were obtained 66 ml of an upper solvent-oil solution layer containing 0.13 wt.% water, 11 ml of a clay layer and 23 ml of a clear water layer of pH 12.3 and containing 65 mg/l of calcium ions and 955 mg/l of sodium ions. Addition of 5 mg/l of Betz 1120 to a further sample of Varsol-bitumen mixture with slaked lime addition had similar results, resulting in 67 ml of solvent-oil solution layer, 10 ml of clay layer and 22 ml of clear aqueous layer.

EXAMPLE III

Samples of heavy crude oil from deposits at Cold Lake, Alberta, Canada, which had been recovered by steam stimulation and de-emulsification, were emulsified (as described in Example I) with 0.2 wt.% deaerated aqueous sodium hydroxide solution to form approximately 50 wt.% oil-in-water emulsions. The viscosities of the emulsion were determined at various shear rates and at temperatures of 4° C., 30° C. and 70°

C. and compared with the viscosities of the crude oil itself.

The results are reproduced in the following Table IV:

TABLE IV

| Shear Rate | Emulsion Viscosity cps Temperature | | | Shear Rate | Crude Oil Viscosity cps Temperature | | |
|---|---|---|---|---|---|---|---|
| $sec^{-1}$ | 4° C. | 30° C. | 70° C. | $sec^{-1}$ | 4° C. | 30° C. | 70° C. |
| 0.47 | 200 | 100 | 300 | 0.13 | 656,000 | 16,000 | 4000 |
| 0.93 | 100 | 100 | 150 | 0.25 | 554,000 | 15,000 | 2000 |
| 2.33 | 40 | 40 | 40 | 0.63 | — | 13,600 | 1200 |
| 4.65 | 30 | 30 | 30 | 1.25 | — | 14,600 | 800 |
| 9.30 | 20 | 30 | 20 | 2.50 | — | 14,200 | 700 |
| 18.60 | 20 | 22.5 | 15 | 5.00 | — | 13,900 | 650 |
| 46.50 | 22 | 26 | 9 | 12.50 | — | 13,680 | 640 |
| 93.00 | 20.5 | 23.5 | 6.5 | 25.00 | — | — | 610 |

The viscosity values of the emulsion were such as to enable the emulsions to be pumped and transported by pipeline while those of the crude oil were considerably higher, even at 70° C., and unsuitable to permit pipeline transportation.

Attempts were made to form emulsions from the crude oil using non-deaerated sodium hydroxide solutions. Emulsion formation was not possible at temperatures up to 50° C. and emulsions formed above that temperature and cooled to 30° C. for viscosity determinations were unstable. Emulsions formed at 70° C. and maintained thereat appeared to be stable. The use and maintenance of such high temperatures in pipeline transportation is uneconomic.

SUMMARY OF DISCLOSURE

In summary of this disclosure, the present invention provides procedures for emulsifying and for pipeline conveying of heavy crude oils in emulsion form which are advantageous. Modifications are possible within the scope of this invention.

What we claim is:

1. A method of transporting a heavy crude oil having an API gravity of less than 25° and containing groups capable of forming surfactants from a first location connected by a pipeline to a second location, which comprises:

contacting said heavy crude oil at said first location with deaerated water containing at least sufficient strong base to provide a pH of the water of at least about 11 so as to form an oil-in-water emulsion from the crude oil having a viscosity of less than 200 centistokes at 60° F., transporting said emulsion through said pipeline to said second location, contacting said emulsion with slaked lime at said second location to invert said emulsion to form a water-in-oil emulsion, and dewatering said water-in-oil emulsion to separate said oil from said emulsion.

2. The method of claim 1 wherein said strong base is sodium hydroxide.

3. The method of claim 1 wherein said pH is at least about 12.

4. The method of claim 1, 2 or 3 wherein said emulsion is transported through said pipeline at a speed of about 5 to 6 ft/sec.

5. The method of claim 1, 2 or 3 wherein said oil-in-water emulsion has a concentration of about 40 to about 60 wt% crude oil.

6. The method of claim 1 wherein said dewatering is effected using solvent extraction of the crude oil from the water-in-oil emulsion.

7. The method of claim 6 wherein the aqueous phase resulting from said oil separation is recycled through a second pipeline from said second location to said first location for utilization in said formation of oil-in-water emulsion at said first location.

8. The method of claim 6 wherein the aqueous phase resulting from said oil separation is neutralized and discharged.

9. A method of transporting a heavy crude oil having an API gravity of less than 25° and containing groups capable of forming surfactants from a first location connected by a pipeline to a second location, which comprises:

contacting said heavy crude oil at said first location with deaerated water containing at least sufficient strong base to provide a pH of at least about 11 so as to form an oil-in-water emulsion from the crude oil having a viscosity of less than 200 centistokes at 60° F., transporting said emulsion through said pipeline to said second location, mixing with said oil-in-water emulsion at said second location at least sufficient slaked lime to effect immersion of said emulsion to a water-in-oil emulsion, at least sufficient water-immiscible solvent for said crude oil and at least sufficient water-soluble high molecular weight partially hydrolyzed polyacrylamide to effect phase separation of the resulting mixture to form a solvent-oil solution phase, an aqueous phase and a compact mineral phase, separating said phases, and recovering oil from said solvent-oil solution.

10. The method of claim 9 wherein said aqueous phase is recycled by a second pipeline from said second location to said first location.

11. A method of transporting a heavy crude oil having an API gravity of less than 25° and containing groups capable of forming surfactants from a first location connected by a first pipeline to a second location, which comprises:

contacting said heavy crude oil at said first location with deaerated water containing at least sufficient sodium hydroxide to provide a pH of the water of about 12 so as to form an oil-in-water emulsion from the crude oil having a viscosity of less than 200 centistokes at 60° F. and a concentration of about 40 to about 60 wt.% crude oil, transporting said emulsion through said first pipeline to a second location, contacting said emulsion at said second location with at least sufficient slaked lime to invert said emulsion to form a water-in-oil emulsion, dewatering said water-in-oil emulsion to separate the oil therefrom and form an aqueous solution of sodium hydroxide containing at least a substantial proportion of the sodium hydroxide used in said formation of said oil-in-water emulsion, recovering the separated crude oil, recycling said aqueous sodium hydroxide solution through a second pipeline from said second location to said first location, and utilizing said recycled aqueous sodium hydroxide solution in said formation of said oil-in-water emulsion.

* * * * *